United States Patent [19]

Bernatt

[11] 4,241,248

[45] Dec. 23, 1980

[54] CIRCUIT INTERRUPTING DEVICE

[75] Inventor: Joseph Bernatt, Casa Grande, Ariz.

[73] Assignee: S & C Electric Company, Chicago, Ill.

[21] Appl. No.: 951,687

[22] Filed: Oct. 16, 1978

[51] Int. Cl.[3] ..... H01H 33/14

[52] U.S. Cl. ..... 200/145; 200/148 A; 200/148 F

[58] Field of Search ..... 200/144 R, 148 R, 148 A, 200/148 B, 148 C, 148 D, 148 E, 148 F, 148 G, 148 H, 148 J, 148 BV, 145

[56] References Cited

U.S. PATENT DOCUMENTS

| | | | |
|---|---|---|---|
| 3,221,129 | 11/1965 | Young | 200/148 B |
| 3,769,479 | 10/1973 | Leeds | 200/148 A |
| 3,909,572 | 9/1975 | Tsubaki et al. | 200/148 A |
| 4,103,128 | 7/1978 | Kosaku | 200/148 D |

*Primary Examiner*—J. V. Truhe

*Assistant Examiner*—Morris Ginsburg

*Attorney, Agent, or Firm*—John D. Kaufmann

[57] ABSTRACT

A circuit interrupting device has a stationary contact. A movable contact is carried by a movable double-walled conductive tube which is telescoped and electrically continuous with a stationary tube. The tubes carry all of the current through the device. A piston carried by the stationary tube defines a piston-cylinder with the movable tube. When the movable tube moves to open the contacts, the piston-cylinder forces dielectric gas to and past the gap therebetween. In a two-gap version of the device the stationary tube is also double-walled and carries a second stationary contact. A piston carried by the movable tube defines a piston-cylinder with the stationary tube. When a second movable contact jointly moves with the first movable contact to open the contact pairs, both piston cylinders force dielectric gas to and past both gaps.

5 Claims, 7 Drawing Figures

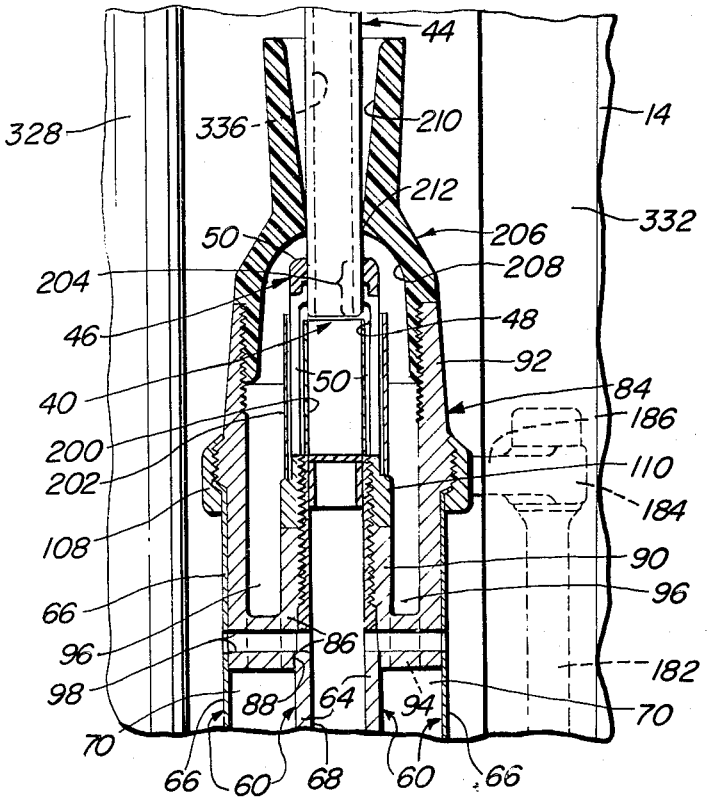
FIG-3
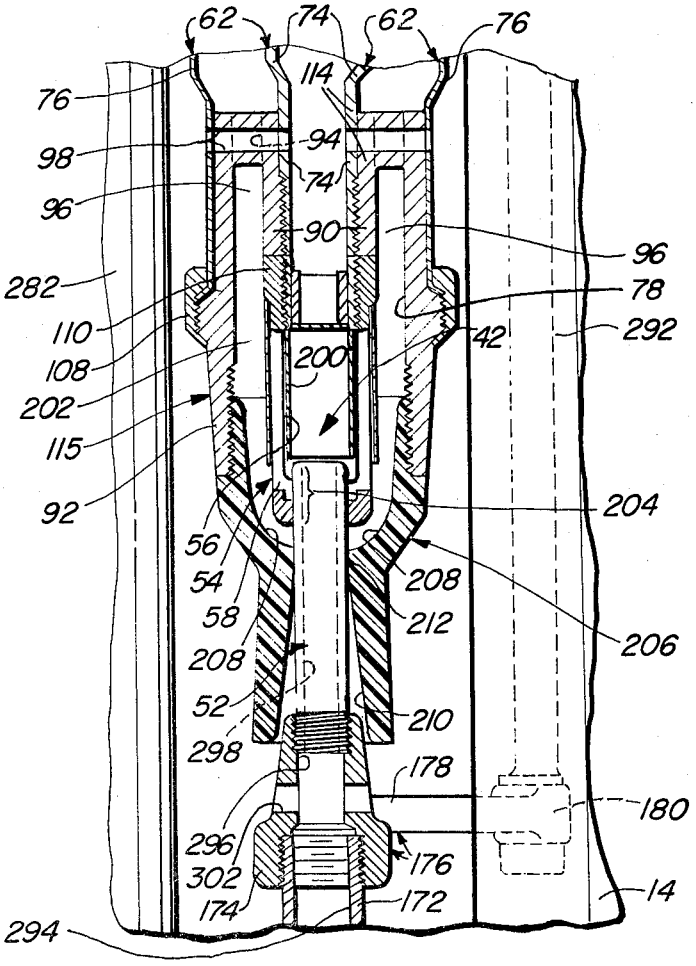

44
336
210
206
212
40
204
50
48
46
200
208
202
354
352
110
356
360
358
376
355
350
378
386
388
384
356
380
388
388
374
382
372
370
350
28'
366
364
14
350
271
268
12
270
362
264
266
274
368
224
278
240
250
232
230
21
252
226
242
220
222
170
246
248
244
226

210
212
44
206
208
208
46
204
200
50
50
48
48
84
202
109
68
108
106
110
104
110
96
66
96
68
92
64
64
92
90
90
84
96
66
98
100
102
102
98
100
86
94
94
88
5
5
66
64
64
68
70
60

CIRCUIT INTERRUPTING DEVICE

BACKGROUND OF THE INVENTION

1. Field of the Invention

The present invention relates to an improved circuit interrupting device and more particularly, to single or multi-gap interrupting devices, which utilize a puffing principle.

2. Discussion of the Prior Art

Circuit interrupting devices of a wide variety of types are well-known. Such devices include, fuses, circuit breakers, reclosers, circuit-switchers, and similar and related devices having various common and commercial names. Specifically, most if not all of these devices perform circuit interruption of two primary actions. The first action involves the intentional formation of an arc upon separation of a pair of normally engaged contacts, between the separating contacts. The arc is elongated as the contacts separate and this elongation aids in extinguishing the arc and interrupting the circuit. The second primary action involves the use of a specialized medium, or environment, in which the arc is formed. This environment may include one of a large number of materials which are inimical to arcs. Many fuses utilize so-called ablative arc-extinguishing materials such as boric acid. When the arc impinges on the boric acid, large quantities of turbulent, cooling and deionizing gases are rapidly evolved. The action of these gases in conjunction with arc elongation ultimately extinguishes the arc. At times, in non-fuse circuit interrupting devices, similar ablative materials are used. However, in many non-fuse circuit interrupting devices, liquid or gaseous media are provided which aid in circuit interruption. Typical of such a medium, is sulphurhexafluoride ($SF_6$)Sulphurhexafluoride has excellent dielectric and arc-extinguishing properties. However, it has been found, especially at particular voltages and currents, that the mere presence of sulphurhexafluoride in insufficient to ensure arc extinguishment in conjunction with arc elongation. As a consequence, a wide variety of devices have been evolved in which the sulphurhexafluoride is puffed, or otherwise caused to flow at a high rate in the vicinity of the arc as it is being extinguished. These types of circuit interrupting devices are often referred to as "puffer" circuit interrupting devices.

Circuit interrupting devices of the puffer type have tended in the past to be very complicated and extremely difficult to assemble in addition to being quite expensive. Accordingly, one object of the present invention, is the provision of a circuit interrupting device, which is simple in construction and operation, inexpensive to manufacture, and consequently, inexpensive to the buyer.

The various types of known circuit interrupting devices have varying operational characteristics and features, which make their use technically attractive in some environments, but technically less attractive in others. In the past, operational features tended to be the only criteria determining which type of device was to be used. Today, however, the relative cost of the device is becoming an important, if not the most important, determinant in deciding which device shall be used in a particular environment. Users of these devices are today often willing to forego purchasing exotic, broad-range, interrupting capability devices in favor of inexpensive, simple devices, even though the latter may have more limited interrupting capabilities.

One use environment in which users today are inclined to employ less expensive, simple devices, is that of transformer protection. Devices which up to now have been employed for transformer protection have been either (1) complicated or expensive, or both, or (2) simple and inexpensive, but not reusable. Economic conditions have forced equipment users, especially utilizes, to consider employing transformer protective devices which are not broad-range, and are therefore less versatile or sophisticated, but which are at the same time substantially less expensive. Specifically, many utilizes have come to realize that there are times when it is expeditious to use an inexpensive interrupting device having a more limited interrupting rating, as opposed to a broad-range interrupting device, if the inexpensive device is sufficiently less expensive that alternative broad-range devices, so as to make the use of the former attractive from a capital investment standpoint. The attractiveness of such inexpensive devices is enhanced if they are reusable. Thus, a further object of the present invention is the provision of a reliable, inexpensive, simple and reusable interrupting device having limited interrupting capabilities.

If a broad-range device such as a circuit breaker is used as a sole device protecting a transformer, several potential negative aspects, in addition to its high cost, may be present. First, impedance of the transformer, and of the conductors between the transformer and the breaker, may so limit currents on the transformer's primary caused by secondary faults, that the breaker does not timely respond. Second, because of the high cost, it is often expedient to apply breakers to protect several branch circuits fed by a larger transmission or distribution circuit. In this event, operation of the breaker, due to a secondary fault in a transformer located in one such branch circuit, de-energizes all such branch circuits. Thus, a fault in one part of a system may render inoperative a large portion of the system. If the breaker is moved closer to the transformer, and does not involve branches other than the one in which the transformer is located, if may be under-utilized, having the ability of more extensive system protection. Such under-utilization is unattractive from a cost standpoint. Accordingly, another object of the present invention is the provision of the circuit interrupting device, which from a cost standpoint, is not under-utilized in providing limited protection for a limited portion of an electrical circuit.

Placement of a relatively cheap protective device—such as a fuse—intermediate a breaker (protecting several branches) and the transformer (in one of the branches) is an obvious expedient. However, until recently, choices of such cheaper devices have been limited. Moreover, where fuses are used, they must be replaced or replenished following performance of their protective function. Fuse-like devices which are reliable, relatively inexpensive, and partly reusable have only lately become available. See, for example, the following commonly-assigned U.S. patents and patent applications: Ser. No. 909,144 filed May 24, 1978 and U.S. Pat. Nos. 4,183,005 issued Jan. 8, 1980 in the names of O. Meister and T. J. Tobin; and 4,161,711 issued July 17, 1979 in the name of O. Meister. Nevertheless, another object of the present invention is to provide a reliable, inexpensive, and reusable, limited fault capability device, as an alternative to fuses, fuse-like devices, and breakers, for placement between a transformer and a more expensive broad-range interrupting device.

Yet another object of the present invention, is the provision of a simple, reliable, inexpensive interrupting device, having a limited interrupting rating, but which nevertheless is attractive in view of its low cost, which is completely bus- or line-mountable, and which operates entirely on bus or line potential. Such a device is even more attractive should its entire sensing and "intelligence" be at line or bus potential, thus obviating the need for complex interconnections between the interrupting device and its "intelligence" and sensing. From a cost standpoint, it is also desirable that such a device be usable and manually resettable from the ground to obviate the necessity of expensive and complicated reclosing mechanisms. Toward these ends, the circuit interrupting device of the present invention, is usable with an operating mechanism disclosed in a co-pending, commonly assigned, U.S. patent application Ser. No. 930,774, filed Aug. 3, 1978 in the names of J. Opfer and K. Vojta. The operating mechanism of the last-mentioned patent application is entirely at line or bus potential as is its "intelligence." The operating mechanism and its "intelligence" are intended to sense current conditions in the circuit in which the circuit interrupting device is connected to selectively operate the device in accordance with those current conditions. If it is desired to also add a so-called "shunt trip" mechanism to the device, such may be of the type disclosed in co-pending, commonly assigned, co-filed U.S. patent application, Ser. No. 951,681, filed Oct. 16, 1978 in the names of J. Bernatt and K. Vojta. The "shunt trip" mechanism in the last-mentioned patent application, effects operation of the circuit interrupting device depending upon the occurrence of events other than the condition of the current in the circuit being protected. Such other events include over-pressure in a transformer being protected, undesirable differential currents in the transformer, or simply, the opening or interrupting of the circuit in order to perform normal maintenance or repair.

Circuit interrupting devices which rely on fluids or gases such as $SF_6$ for extinguishing arcs, generally involve sealed housings surrounding the elements of the device which interrupts the circuit. It is generally desirable to maintain the $SF_6$ within the housing at a predetermined, super-atmospheric pressure, slightly in excess of one atmosphere. If the pressure of the gas within the housing reaches too high a level for whatever reason, there is a danger that the housing may fracture or break. Additionally, if the pressure of the gas or the housing falls to too low a level, there is the possibility that the arc-extinguishing capability of the device may be hindered if not eliminated. Accordingly, the circuit interrupting device of the present invention, may also be used with a combined pressure relief and pressure indicating mechanism disclosed in commonly assigned, co-pending, co-filed U.S. patent application Ser. No. 951,686, filed Oct. 16, 1978 in the name of J. Bernatt. The mechanism of this last named Patent Application, both indicates the presence of a too low pressure in the housing and automatically relieves over-pressures therewithin.

Another overall object of the present invention is therefore aimed at the provision of a simple, reliable, low-cost circuit interrupting device for use in a variety of environments and with a variety of operating mechanisms, shunt trip mechanisms and other associated mechanisms, wherein fault interrupting ability is achieved at low cost.

SUMMARY OF THE INVENTION

The present invention relates to an improved circuit interrupting device. Both single and multi-gap devices are included. As to the more generic single-gap device, the device is of the general type having first and second normally engaged, separable contacts within an insulative housing. The housing is sealed against the escape of a pressurized dielectric gas therein. A pair of opposed terminals on the housing are connectible to opposed points of a circuit which is to be protected. Separation of the contacts within the dielectric gas environment creates a gap therebetween, in which an arc is formed and ultimately extinguished due to arc elongation and the action of the dielectric gas.

The improved device includes a first facility which stationarily mounts the first contact and electrically connects this contact to one of the terminals. A first axially movable conductive tube carries the second contact on a first end for movement therewith relative to the first contact. A second stationary conductive tube is telescoped with the first tube at the second ends of both of them. The first end of the second tube is electrically connected to the other terminal. The tubes together normally carry all current flowing through the device.

A piston-cylinder facility is also provided. The piston-cylinder facility includes a first piston carried by the second end of the second tube which co-operates with the first tube to flow gas from the first end of the first tube to and past both of the engaged contacts and the gap formed between the contacts as the first tube moves relatively to the second tube. Moreover, facilities are provided in the piston cylinder facility for electrically connecting together the tubes in all relative positions thereof. In a preferred embodiment of the generic single-gap device, the first tube is double walled and the piston resides between the double walls of the first tube, defining therewith a variable volume containing the gas. When the variable volume decreases as the first tube moves to separate the contacts, the double walls of the first tube and the piston comprise the piston-cylinder facility.

In the less generic two-gap version of the device, the electrical interconnection between the first end of the second tube and the other terminal, includes a stationary third contact which is carried by the first end of the second tube, and a movable fourth contact which normally engages the second stationary third contact, and is movable away therefrom to open a second gap. Facilities are provided for conjointly moving the movable fourth contact and the first tube the latter movement of course also moving the second contact. Further, the second tube is also double-walled. A second piston-cylinder facility includes a second piston carried by the second end of the first tube, which interacts with the second tube to flow the gas from the first end of the second tube to and past both the engaged stationary third and movable fourth contacts and the second gap as the first tube moves relatively to the second tube. The second piston preferrably resides between the double walls of the second tube to define therewith a second variable volume. The second variable volume decreases when the first tube moves to separate the contacts and the double walls of the second tube and the second piston therefore act as the second piston-cylinder facility.

BRIEF DESCRIPTION OF THE DRAWING

FIG. 3 is a side elevation, partially sectioned, enlarged view of the interrupting unit shown in FIG. 2 and depicting in greater detail the various elements thereof;

DETAILED DESCRIPTION

Figure 1:
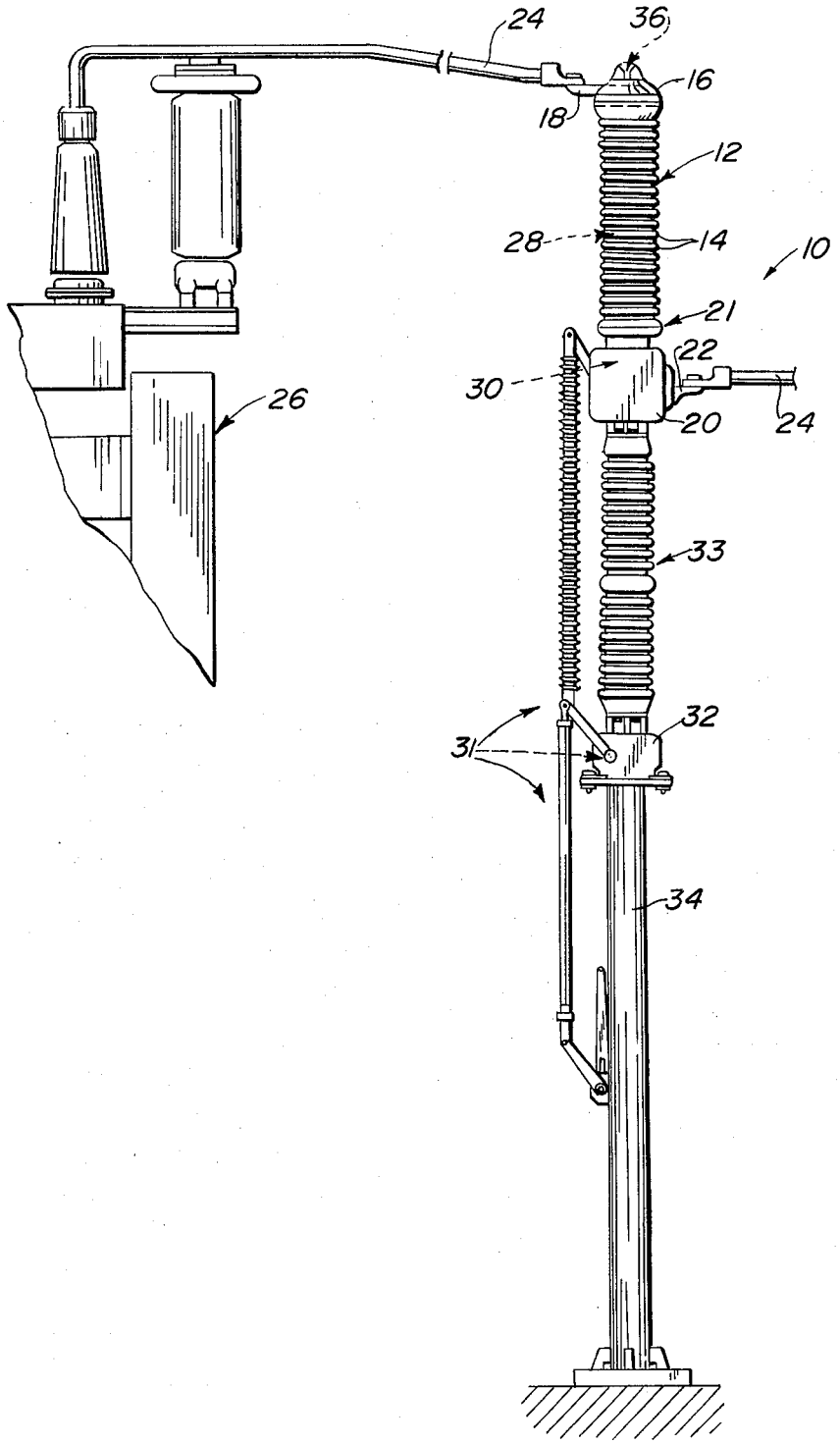
FIG. 1 is a side elevation of a vertically-oriented circuit interrupting device, according to the present invention.

General—FIG. 1

Referring first to FIG. 1, there is shown an interrupting device 10 according to the principles of the present invention. The device 10 preferably has an elongated, cylindrical shape, and is enclosed in an insulative housing 12 of that configuration. The housing 12 may be made of porcelain or other insulative material, and may include one or more leakage distance-increasing skirts 14, all as well known. One end of the housing 12 carries a bell housing 16 made of conductive metal which carries an integral terminal pad 18 thereon. The other end of the housing 12 carries an operating mechanism housing 20 on a mounting flange 21 thereof, both also of a conductive metal; the housing 20 carries an integral terminal pad 22. The opposed terminal pads 18 and 22 are connectable to opposed points of a bus 24 which feeds a transformer 26. Thus, the device 10 is serially connectable between the transformer 26 and a power source (not shown) for protection of the transformer 26 against overcurrents (including short circuit currents and fault currents), a circuit being normally completed through the device 10 via the terminal pads 18 and 22.

The device 10 of the present invention, includes an interrupting unit 28 contained in the housing 12 which interrupts or opens the circuit between the power source and the transformer 26, including extinguishment of any arc or arcs formed incident to circuit opening. The interrupting unit 28 may be operated by an operating mechanism 30 contained within the housing 20; the mechanism 30 does not form a part of the present invention. A type of mechanism 30 capable of providing high-speed, linear mechanical movement which may be used, is shown in commonly-assigned U.S. patent application, Ser. No. 930,774, filed 8-3-78 in the names of J. Opfer and K. Vojta. Other suitable mechanisms 30 for providing high-speed, linear movement may be used (possibly with modifications), as, for example, that shown in commonly-assigned U.S. Pat. No. 3,769,477 to Chabala, et al. Preferably, the operating mechanism 30 is of a type which operates the interrupting unit 28 in response to the current condition in the protected circuit 24,26 (sensed either within the mechanism 30, or exteriorly thereof). If desired, the mechanism may be used jointly with a shunt trip mechanism 31 partially contained in a housing 32. The shunt trip mechanism 31 is responsive to a relaying or other sensing scheme for operating the interrupting unit 28 in response to any predetermined event in the circuit 24,26 or elsewhere in the electrical system of which the circuit 24,26 is a part. Such events include overpressure or undesirable differential currents in the transformer 26, as well as the mere opening of the circuit 24,26 in order to perform maintenance, repair or inspection thereof. A shunt trip mechanism 31 usable in the present device 10 is disclosed in commonly-assigned, co-pending, co-filed U.S. patent application, Ser. No. 951,686, filed Oct. 16, 1978 in the names of J. Bernatt and K. Vojta.

The device 10 may be mounted in any desired orientation, a vertical orientation being shown in FIG. 1. To this end, the housings 20 and 32 may be insulatively spaced apart by a vertical insulator stack 33. The housing 32 may be supported by a pedestal 34 on the ground. As more fully set forth below, in its preferred forms, the device 10 is sealed so that ordinarily the interior of the housing 12 is not in communication with the ambient atmosphere. The bell housing 16 may contain a pressure indicating and pressure relief mechanism, generally indicated at 36, as more fully described in co-pending, commonly-assigned, co-filed U.S. patent application Ser. No. 951,686, filed Oct. 16, 1978 in the name of J. Bernatt. As will appear below, the device 10 is of a type wherein the housing 12 of the interrupting unit 28 is filled with a pressurized dielectric gas, such as $SF_6$. It is in the environment of such pressurized gas that circuit interruption and arc extinguishment occurs within the housing 12 due to the operation of the unit 28 by the operating mechanism 30, or by the shunt trip mechanism 31. The normal pressure of the gas is preferred to be in the approximate range of 40–50 psig. Should this pressure drop substantially below 40 psig for any reason, a visual indication thereof is given by the mechanism 36 to personnel on the ground. If the pressure exceeds 65 psig for any reason, the mechanism 36 permits venting of the interior of the housing 12 to the ambient atmosphere to relieve the pressure and to prevent mechanical failure of the housing 12.

Interrupting Unit 28—Two Gap—FIGS. 2,3&5–7

Figure 2:
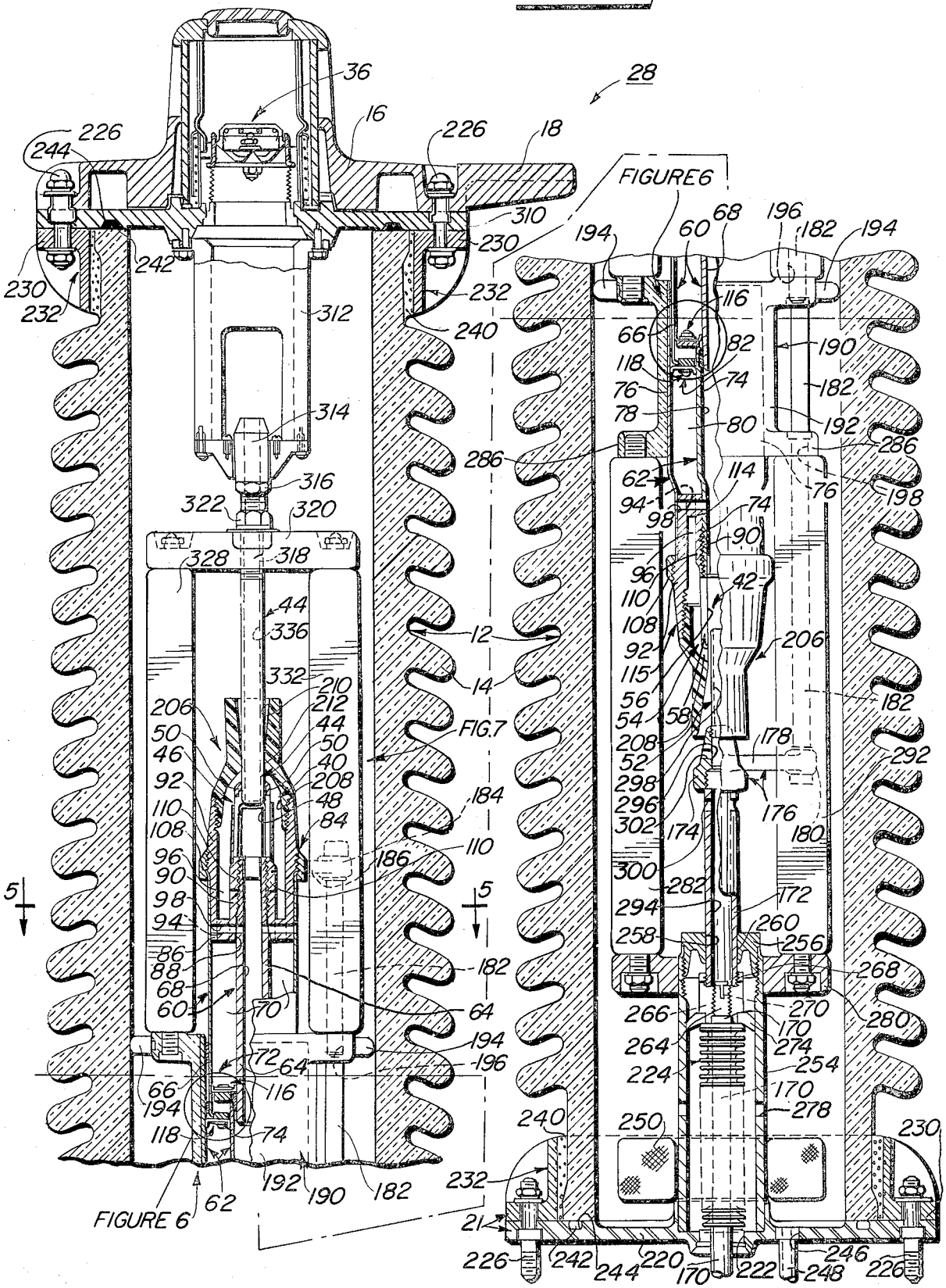
FIG. 2 is a side elevation, partially sectioned view of a two-gap interrupting unit for the device generally depicted in FIG. 1 in accordance with the principles of the present invention.

The interrupting unit 28 comprises the heart of the present invention and is here described in detail with initial reference to FIG. 2. The interrupting unit 28 is seen to generally comprise a first pair 40 of current-carrying and interrupting contacts at the top of the interrupting unit 28 and a second pair 42 of current-carrying and interrupting contacts at the bottom thereof. The first pair of contacts 40 comprises a stationary metalic contact 44 and a movable metallic contact 46. In preferred embodiments, the movable contact 46 has an interior bore 48 in which the stationary contact 44 normally fits. The movable contact 46, may comprise a plurality of spring-biased contact fingers 50 which, when the stationary contact 44 is within the bore 48, slidingly engage the stationary contact 44 for effecting electrical continuity between the contacts 44 and 46.

The second pair 42 of current-carrying and interrupting contacts comprises a movable metallic contact 52 and a stationary metallic contact 54. The movable contact 52 of the second pair 42 is similar in structure to the stationary contact 44 of the contact pair 40. Also, the stationary contact 54 of the contact pair 42 is similar in structure to the movable contact 46 of the contact pair 40. More specifically, the stationary contact 54 of the contact pair 42 includes a central bore 56 into which the movable contact 52 normally fits. When the contacts 52 and 54 are engaged, a plurality of contact fingers 58, similar to the contact fingers 50, slidingly engage the movable contact 52 to effect electrical continuity between the contacts 52 and 54.

The first and second contact pairs 40 and 42 are respectively associated with first and a second double-walled cylinders 60 and 62. Specifically, the movable contact 46 of the first contact pair 40 is carried by the first, movable double-walled cylinder 60, while the stationary contact 54 of the second contact pair 42 is carried by the second stationary double-walled cylinder 62, all in a manner to be hereinafter described in greater detail.

The first double-walled cylinder 60 comprises a metallic tubular inner wall 64 and a metallic tubular outer wall 66 coaxial with the inner wall 64. The inner wall 64 defines a central bore 68 coaxial with the first cylinder 60. Between the inner wall 64 and the outer wall 66 is defined a first compression chamber or volume 70 which serves as the cylinder portion of a piston-cylinder arrangement 72 (FIGS. 2 and 6) to be described in greater detail below.

The second double-walled cylinder 62 is similar in structure to the first cylinder 60 and includes a metallic tubular inner wall 74 and a metallic tubular outer wall 76, the walls 74 and 76 being coaxial. The inner wall 74 defines a central bore 78 similar to and in coaxial connection with the central bore 68 of the first cylinder 60. Defined between the inner and outer walls 74 and 76 is a second compression chamber or volume 80 which forms the cylinder of a piston-cylinder arrangement 82 (FIGS. 2 and 6), to be described in greater detail below.

The upper end of the compression chamber or volume 70 of the first double-walled cylinder 60 is closed by a nozzle carrier 84. Referring generally to FIGS. 2, 3, and specifically to FIGS. 5&7, the nozzle carrier 84 includes a metallic disklike closure member 86 through the center of which is formed, an aperture 88. The central aperture 88 has a diameter substantially equal to the outside diameter of the inner wall 64 of the first double-walled cylinder 60 which the aperture 88 engages. The closure member 86 carries a first cylindrical extension 90, formed integrally therewith and extending upwardly away therefrom and a second integral, cylindrical extension 92 which extends upwardly parallel to the first extension 90 generally coaxial therewith.

Formed through the closure member 86 in a direction generally parallel to the axis of the central aperture 88 are one or more passages 94 which communicate with the compression chamber or volume 70 at one end and at the other end with a chamber 96 defined between the extensions 90 and 92. Formed in the closure member 86 are also a plurality of passageways 98 which extend radially thereof transversely to the major axis of the first double-walled cylinder 60 and to the direction taken by the extensions 90 and 92. These passageways 98 communicate at one end, with the space enclosed by the housing 12, through aligned holes 100 formed through the outer wall 66 and, at their other end, with aligned holes 102 formed through the inner walls 64 of the first cylinder 60 (see FIG. 7). The holes 102 in turn, communicate through the inner wall 64 with the central bore 68. Accordingly, the passageways 98 and the holes 100&102 permit communication between the central bore 68 and the space enclosed by the housing 12.

Figure 7:
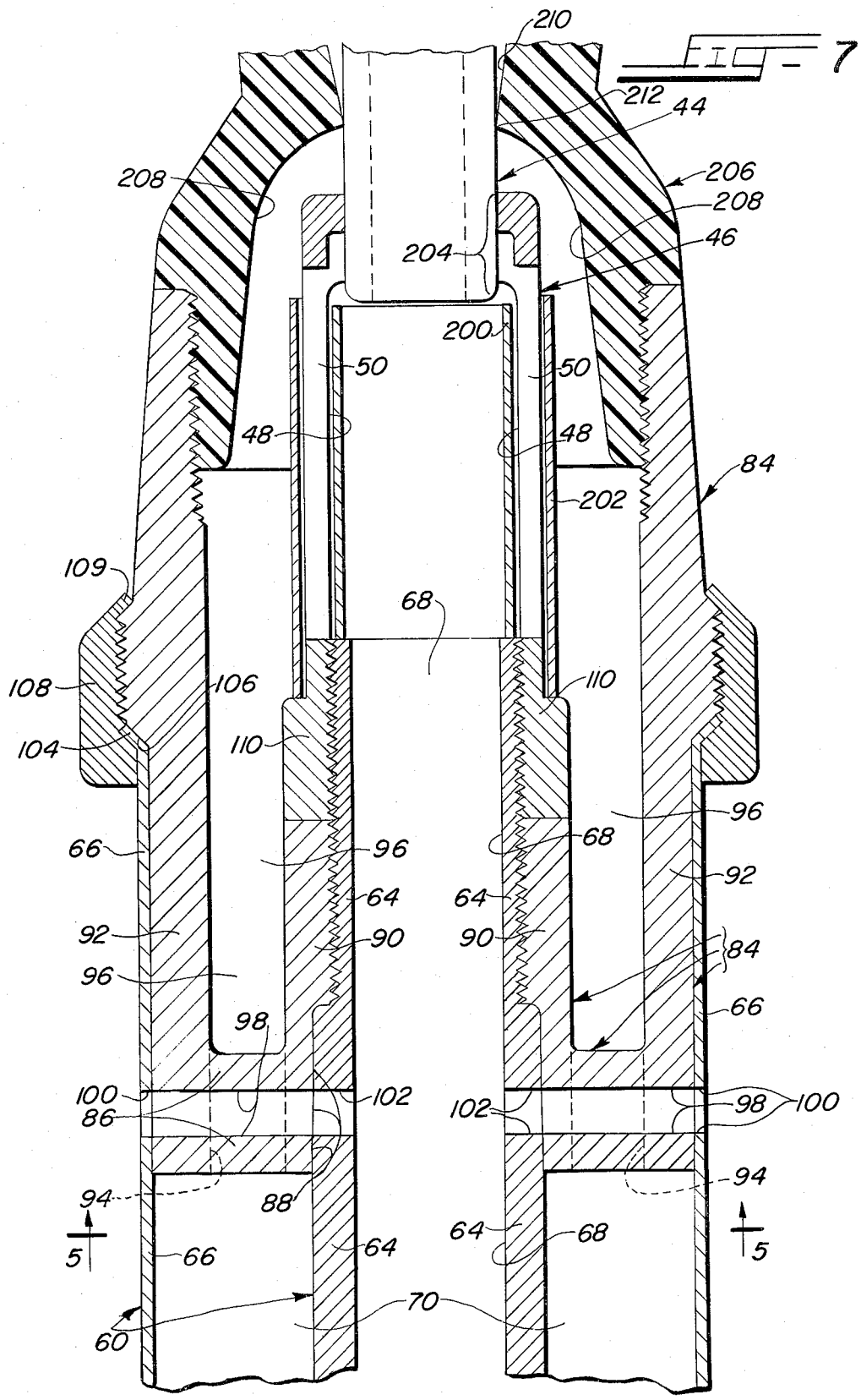

The nozzle carrier 84 is attached to the first double-walled cylinder 60 in any convenient manner. As depicted in FIGS. 2,3&7, the interior of the first extension 90 is threaded onto the outside of the inner wall 64 at its upper end. Threading of the nozzle carrier 84 onto inner wall 64 is effected so that the passageways 98 are aligned with the holes 102.

Such attachment of the nozzle carrier 84 to the inner wall 64 closes the otherwise open end of the compression chamber or volume 70 with the member 86. The outer wall 66 of the first cylinder 60 is also attached to the nozzle carrier 84. Specifically, such attaching is achieved by forming the upper end of the outer wall 66 in a slight flare, as at 104. The flare 104 rests against a shoulder 106 formed on the outside of the second extension 92. The shouler 106 may be threaded as shown. An internally-threaded collar 108 may be threaded onto the shoulder 106 trapping the flare 104 between the collar 108 and the shoulder 106. An upper edge 109 of the collar 108 may thereby inwardly deformed to lock the collar 108 in place. Thus, the compression chamber or volume 70 is closed by the closure member 86 of the nozzle carrier 94, but is permitted to communicate with the chamber 96 through the passages 94.

Referring again to FIGS. 2,3&7, the contact fingers 50 of the movable metal contact 46 of the first contact pair 40 are carried by or are integral with an internally-threaded collar 110. The collar 110 is threaded onto the exterior threads formed at the upper end of the inner wall 64 which extend beyond the first extension 90. Such threading is effected until the collar 110 seats against the first extension 90. Thus, the bore 48 of the movable metal contact 46 communicates with the central bore 68 defined by the inner wall 64. Consequently, a continuous path is formed between the bore 48, the central bore 68, the holes 102, the passageways 98, the holes 100 and the space enclosed by the housing 12. This path communicates with the path defined by the compression chamber or volume 70, the passages 94 and the chamber 96 only at the spaces between the contact fingers 50.

The second compression chamber or volume 80 is closed at its lower end by a closure member 114 forming a part of a nozzle carrier 115 which are in all respects similar in structure to the closure member 86 and the nozzle carrier 84. As a consequence of this similarity, the various elements of the nozzle carrier 15 bear the same reference numerals as do the corresponding elements of the nozzle carrier 84. The closure member 114 and the nozzle carrier 115 are mounted between the inner and outer walls 74 and 76 of the second cylinder 62 in a manner similar to the mounting of the closure member 86 to the first cylinder 60, and, again, similar reference numerals have been used to depict the various elements for achieving this end. The contact fingers 58 of the stationary contact 54 carried by the second cylinder 62 are mounted to the inner wall 74 of the second cylinder 62 in a manner similar to the mounting of the contact fingers 50 to the inner wall 64 of the first cylinder 60. The same reference numerals have been used to denote similar elements for achieving this end.

Figure 6:
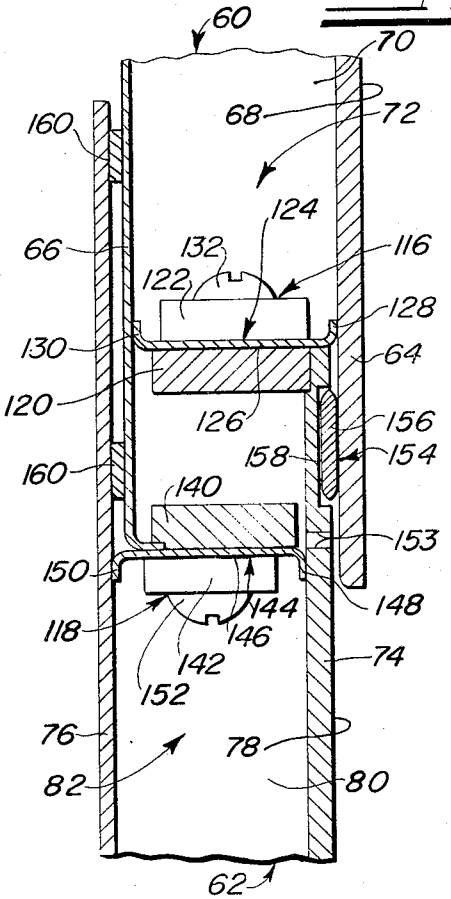

Referring to FIGS. 2&6, the lower end of the compression chamber or volume 70 and the upper end of the compression chamber of volume 80 are respectively closed by piston facilities 116 and 118 which, together with the compression chambers or volumes 70 and 80, constitute the piston-cylinder arrangements 72 and 82. The piston facility 116 is carried by the inner wall 74 of the second cylinder 62, while the piston facility 118 is carried by the outer wall 66 of the first cylinder 60.

The first and second cylinders 60 and 62 are telescoped into each other. In the embodiment shown, the inner wall 64 of the first cylinder 60 is located inside the inner wall 74 of the second cylinder 62; the outer wall 66 of the first cylinder 60 is located within the outer wall 76 of the second cylinder 62. An opposite telescoping arrangement could also be used, as should be apparent.

Referring specifically to FIG. 6, the piston facility 116 comprises a mounting member 120 attached to, or formed integrally with, the the inner wall 74 of the second cylinder 62. The mounting member 120 may have an annular configuration and may extend completely around the outer periphery of the inner wall 74. Trapped or clamped between the mounting member 120 and an annular mounting plate 122 is an annular piston cup member 124 made of a tough, flexible material which has the ability of slidingly and sealingly engaging adjacent surfaces. The piston member 124 may be made of a material sold under the trademark Rulon; any other convenient material may be used. The piston member 124 has a main body portion 126 and first and second flange portions 128 and 130 formed integrally therewith. The flange 128, hereinafter referred to as the inner flange, is so formed as to be in constant, sealing, sliding engagement with the outer surface of the inner wall 64 of the first cylinder 60. The flange 130 is so configured as to be in constant, sliding, sealing engagement with the inner surface of the outer wall 66 of the first cylinder 60. The main body portion 126 of the piston member 124 is clamped between the mounting member 120 and the mounting plate 122, the latter being affixed to the mounting member 120 by an convenient means such as a screw 132. Should the first cylinder 60 move downwardly with respect to the stationary second cylinder 62, the piston facility 116 which is mounted to the stationary cylinder 62 compresses any gas within the compression chamber or volume 70 due to the relative movement of the walls 64 and 66 with respect thereto. Such compression is effected by the decrease in size of the compression chamber or volume 70. This compression causes any gas within the compression chamber or volume 70 to flow through the passages 94 in the closure member 86 and into the chamber 96 (See FIG. 7). Such flowing gas then moves from the chamber 96 to the vicinity of, and past, the stationary contact 44 and the movable contact 46 (FIGS. 2&3).

The piston facility 118 is similar to the piston facility 116. Specifically, the piston facility 118 includes a mounting member 140 attached to, or formed integrally with, the outer wall 66 of the first cylinder 60. Trapped or clamped between the mounting member 140 and a mounting plate 142 is a piston member 144 which is similar to the piston member 124 and made of a similar material. A main body porton 146 of the piston member 144 is trapped between the mounting member 140 and the mounting plate 142 and includes at either end flange portions 148 and 150. The inner flange 148 constantly slidingly and sealingly engages the outside surface of the inner wall 74 of the second cylinder 62, while the outer flange 150 slidingly and sealingly engages the inside surface of the outer wall 76 of the second cylinder 62. The mounting plate 142 may be secured to the mounting member 140 by a screw 152.

Should the movable cylinder 60 move downwardly with respect to the stationary cylinder 62, movement of the outer wall 66 thereof moves the piston facility 118 downwardly. Such downward movement of the piston facility 118 decreases the compression chamber or volume 80 to compress any gas therein. Such compression causes the gas to flow from the compression chamber or volume 80 through the passages 94 formed through the closure member 114 of the nozzle carrier 115. After passing through the passages 94, the gas flows through the chamber 96 and ultimately flows to and past the area of engagement between the movable contact 52 and the stationary contact 54. Thus, downward movement of the first cylinder 60 effects a decrease in both compression chambers or volumes 70 and 80, and effects the movement of gas within those chambers 70 and 80 to the vicinity of, and past the respective contact pairs 40 and 42 simultaneously.

The configuration of the flanges 128,130 and 148,150 is such that during compression of the volumes 70 and 80, the pressure build-up therein forces the flanges 128,130,148&150 firmly against the respective surfaces they engage. This configuration of the flanges 128,130,148&150 ensures a positive volume decrease in the compression chambers of volumes 70&80 and further ensures the occurrence of the above-described gas flow from those chambers 70&80 to and past the contact pairs 40&42. The volume between the walls 66&74 between the piston facilities 116&118, may be made freely expandable by providing a relief vent 153 through the wall 74.

Electrical continuity between the inner walls 64&74 of the cylinders 60&62 is assured by a contact transfer band 154. Any other convenient type of current transfer mechanism may be used. The contact transfer band 154 is shown in the preferred embodiment to comprise a metallic ring 156, the outside surface of which resides in a groove 158 formed in the inside surface of the inner wall 74 of the second cylinder 62. The metal ring 156 remains stationary with the second cylinder 62 and slidingly, electrically engages the outside surface of the inner wall 64 of the first cylinder 60 as that cylinder 60 moves downwardly or upwardly. Thus, at all times there is electrical continuity between the movable contact 46 (including the contact fingers 50) associated with the first cylinder 60 and the stationary contact 54 (including the contact fingers 58) associated with the second cylinder 62. Such electrical continuity may be traced as follows from top to bottom (FIGS. 2, 3, & 6): The contact fingers 50, the collar 110, the first extension 90, the inner wall 64 of the first cylinder 60, the metal ring 156, the inner wall 74 of the second cylinder 62, the first extension 90 of the nozzle carrier 115, the collar 110 and the contact fingers 58. As long as the interrupting unit 28 remains in its normal, unoperated condition shown in the Figures whereat both contact pairs 40 and 42 are closed, electrical continuity will also exist between the stationary contact 44 and the movable contact 52. As described subsequently, the stationary contact 44 is electrically continuous with the terminal pad 18, while the movable contact 52 is electrically continuous with mounting flange 21 and the terminal pad 22 (FIGS. 1 & 2). Thus, in the normal, unoperated condition of the interrupting unit 28, electrical continuity exists between the terminal pads 18 & 22.

Concentricity of the cylinders 60 and 62 and low friction, relative movement therebetween is assured by one or more low friction guide members 160 interposted at various location between the outer surface of the outside wall 66 and the inner surface of the outside wall 76. The members 160 may have any desired configuration. See FIG. 6.

Returning to FIG. 2, an operating rod 170 extends into the housing 12 through the flange 21 at the lower end of the interrupting unit 28. The operating rod 170 is selectively reciprocable, and is connected at one end to the operating mechanism 30 contained within the housing 20 (FIG. 1). The operating rod 170 is connected, as by threading, at its free end to and reciprocates, an elongated reciprocable operating member 172. Preferably, both the rod 170 and the member 172 are coaxial with the housing 12 and with the major axes of the first and second cylinders 60 and 62. The free end of the operating member 172 is externally threaded, the threads interfitting with interior threads of a hollow connection nipple 174, thus mounting the nipple 174 to the operating member 172. The free end of the connection nipple 174 is similarly internally threaded and connected to a threaded section on the lower end of the movable contact 52. Thus, reciprocation of the operating rod 170 reciprocates the movable contact 52.

The connection nipple 174 is conveniently formed as an integral part of a casting 176 which includes one or more arms 178 (only one is shown) extending away from the connection nipple 174 radially of the housing 12. Each arm 178 has at its free end remote from its point of connection to the nipple 174 a hollow boss 180 only one being shown. Held in each boss 180 by any convenient means is an elongated pull rod 182, only one being shown. Each pull rod 182 extends in a direction parallel to the major axis of the housing 12 and to the major axes of the cylinders 60 and 62 toward the collar 108. The free end of each pull rod 182 is held in any convenient manner in a hollow boss 184 on the end of an arm 186 which is attached to or formed integrally with the collar 108. The pull rods 182 are insulative.

Thus, downward reciprocation of the operating rod 170 reciprocates the movable contacts 46 & 52 away from their respective stationary contacts 44 & 54 during an opening operation of the operating mechanism 30 to simultaneously open gaps between the contact pairs 40 & 42. Specifically, downward movement of the nipple 174 moves the pullrods 182 and the collar 108 down. Downward movement of the collar 108 moves the nozzle carrier 84, including the inner extension 90 thereof, down to also move the collar 110 with the fingers 50 and the cylinder 60 down. Simultaneously with the opening of gaps between the contact pairs 40 & 42, then, the compression volumes 70 & 80 decrease to flow gas via the piston facilities 116 & 118 past the gaps.

The various elements thusfar described, may be coaxially maintained within the housing 12 by a mechanical bridge structure 190 best shown in FIG. 2. The bridge 190 includes a central body portion 192 which surrounds and may hold the outer wall 76 of the second cylinder 62. Connected to, or formed integrally with the central portion 192 may be a plurality of centering legs 194, only two of which are shown. The centering legs 194 bear against the inside surface of housing 12 to maintain the cylinders 60 & 62, and the various other elements previously described coaxially of the housing 12. Guide apertures 196 & 198 may be formed in the legs 194. Through these apertures 196 & 198 may pass the pullrods 182 which are guided in their reciprocation thereby.

Not shown in FIG. 2, but depicted in FIG. 3 and best seen in FIG. 7, a mounting member 200 and a spring member 202 are respectively located inside the bore 48 and around the outside of the contact fingers 50. The member 200 may be carried by the collar 110; the member 202 may be carried by the inner wall 64. The mounting member 200 serves to limit the inward deflection of contact fingers 50 to ensure that the stationary contact 44 may enter the bore 48 in the closed position of the interrupting unit 28. The spring member 202 sets the spring tension of the contact fingers 50 to ensure that good electrical contact exists between the contact fingers 60 and the stationary contact 44.

Again, as best seen in FIG. 7, a certain amount of overlap 204 is provided between the contact fingers 50 and the stationary contact 44. Specifically, upon downward movement of the operating rod 170, the overlap 204 maintains the contact fingers 50 and the stationary contact 44 in sliding electrical engagement for some period of time prior to separation therebetween. This has the effect of permitting the initiation of downward movement of the first cylinder 60 to initiate gas flow by both piston cylinder facilities 72 & 82 prior to the separation of the contact fingers 50 and the stationary contact 44, and the consequent formation of an arc therebetween. Thus, at the time the arc is formed, the piston cylinder facilities 72 & 82 are already causing high velocity gas flow in the vicinity of the contact fingers 50 and the stationary contact 44, thus assuring more efficient extinguishment of the arc. The same overlap 204 exists with respect to the contact fingers 58 and the movable contact 52 at the lower end of the interrupting unit 28.

Referring now to FIGS. 2, 3 & 7, a nozzle 206 is seen to be mounted to each nozzle carrier 84 and 115. The nozzle 206 may be formed of a high temperature resistant material such as polytetrafluorethylene (Teflon) and serves to ensure that the gas flowing in the vicinity of the contacts 44 and 46, both when they are engaged and when they are separated, reaches sonic or near sonic velocity. The nozzle 206 is attached by appropriate threads to a similarly threaded portion of the second extension 92 on the nozzle carrier 84. Nozzle 206 defines a first chamber 208 which is continuous with chamber 96 defined between the extensions 90 & 92 of the nozzle carrier 84. The nozzle 206 also defines an outlet chamber 210 which is in communication with the first chamber 208. Thus, gas flowing from the compression volume 70 ultimately flows through the chambers 208 and 210 at sonic or near sonic velocity in the vicinity of the contacts 44 and 46 in both their engaged and separated positions, as well as in the vicinity of the arc formed between these contacts 44 & 46. The chambers 208 and 210 may be separated by a shoulder 212 formed in the nozzle 206. In the normal closed position of the interrupting unit 28 as shown in the figures, the annular shoulder 212 engages the stationary contact 44. This has the effect of confining the dielectric gas being forced from the compression chamber 70 during downward movement of the operating rod 170 to the chamber 208 until the shoulder 212 clears the lower end of stationary contact 44. This structure has been found to increase the efficiency of the arc-extinguishing properties of the dielectric gas flowing from the nozzle 206. Nozzle 206 associated with the nozzle carrier 115 and the contact pair 42 is similar in all respects to the upper nozzle 206 except that the lower nozzle 206 remains stationary with the second cylinder 62. Relative movement between the lower nozzle 206 and the contact 52, is provided by movement of such contact 52.

Referring to FIG. 2, the lower end of the interrupting unit 28 mounts an end plate 220 which may be attached to, or may be formed integrally with, the mounting flange 21. Formed in the end plate 220 is a central aperture 222 through which the operating rod 170 freely passes. A metalllic bellows 224 is sealed to the inside of the end plate 220 around the aperture 222 at one end thereof, and is sealed at its other end about the operating rod 170. The bellows 224 permits free movement of the operating rod 170 without permitting the leakage through the aperture 222 of the dielectric gas contained within the housing 12. Bolts 226 may be provided for both mounting the end plate 220 to the mounting flange 21 and for mounting the interrupting unit 28 to the housing 20 for the operating mechanism 30 (FIG. 1).

The mounting flange 21 may also include a flange 230 formed integrally with an end ring member 232 which is attached to the housing 12 by a quantity of cementatious material 240, such as Portland cement or other adhesive. The bolts 226 pass through appropriate apertures in the flange 230 and may clamp the flange 230 to the end plate 220.

An annular gas seal 242 held in a channel 244 formed in the end plate 220 may be compressed between the channel 244 and the end of the housing 12 to ensure that none of the dielectric gas within the housing 12 leaks out, and also to ensure that ambient atmosphere does not leak into the housing 12 to contaminate the dielectric gas. End plate 220 may also include a filling port 246 to which a filling and pinch off nipple 248 is mounted. Through the nipple 248 the housing 12 may be charged with an appropriate quantity of the dielectric gas at an appropriate pressure, following which the nipple 248 is pinched off to prevent the leakage therefrom of the gas. In the chamber 12 and near the end plate 220 may be located a desiccant chamber 250 which may be charged with an appropriate quantity of desiccant to remove any moisture from the dielectric gas within the chamber 12.

A circular flange 252 is formed on the interior of the end plate 220 about the aperture 222. Mounted to the interior of this flange 252 by any convenient method, is an elongated tubular conductive member 254 which extends upwardly and surrounds the operating rod 170 and the bellows 224. The upper end of the member 254 is closed by a toroidal closure member 256 (FIG. 2) which includes an aperture 258 for passage of the operating member 172 therethrough. The closure member 256 also includes a current transfer band 260 which is in continuous sliding electrical contact with operating member 172. This structure ensures a continuous electrical path between end plate 220 which is electrically connected to the housing 20, and the movable contact 52. Specifically, that path, which does not depend upon conduction by operating rod 170, is from the housing 20 to the end plate 220 and from there through the tubular conductive member 254, the closure member 256 and the current transfer band 260, through the operating member 172 and the nipple 174 to the movable contact 52.

A threaded portion 264 of the operating rod 170 may be threaded into an appropriately threaded joint 266. Operating member 172 may also be threaded into the joint 266, thus joining for mutual reciprocation, the operating rod 170 and the operating member 172. A jamming member 268 also be threaded onto operating member 172 against the joint 266, to ensure that the threaded coupling between the member 172 and the joint 266 does not loosen. To this same end, operating rod 170 may be split as at 270. A jamming member 271 forced into the operating rod 170 outwardly flares portions thereof on either side of the split 270 to ensure that the threaded connection between the operating rod 170 and the joint 266 does not loosen.

A lower portion of the joint 266 mounts a piston member 274, the periphery of which sealingly engages the interior wall of the hollow tubular conductive member 254. The tubular conductive member 254 contains one or more apertures 278 formed therethrough. As the operating rod 170 moves downwardly, so too does the piston 274. Movement of the piston 274 compresses any gas within the tubular conductive member 254, but this gas is freely vented to the interior of the housing 12 through the apertures 278. The initial locations of the piston member 274 and the apertures 278 are such that as the interrupting unit 28 nears its fully opened position, piston member 274 passes the apertures 278. At this time, any gas contained within the tubular conductive member 254 is compressed to perform a dashpot action. Specifically, this dashpot action slows down the operating rod 170 and all of the movable elements within the interrupting unit 28. This prevents sudden jarring or severe mechanical shock of the elements of the interrupting unit 28, and of the operating mechanism 30.

Surrounding and mounted to the tubular conductive member 254 is a support and mounting ring 280. One end of one or more insulative support rods 282 is appropriately mounted to the support and mounting ring 280. The other end of the insulative support rods 282 is appropriately mounted to a leg 286 connected to or formed integrally with the mechanical bridge structure 190. The insulative support rods 282 serve to fix the position of the mechanical bridge 190 with respect to the lower end of the interrupting unit 28. Also connected between the support and mounting ring 280 and the mounting leg 286, may be one or more voltage grading capacitors 292 which serve to grade to voltage across the gap open between contact pair 42. The voltage grading capacitors 292 also serve the same structural function as served by the insulative support rods 282 in fixing the location of the bridge 190 with respect to the lower end of the interrupting unit 28.

A longitudinal passageway 294 is formed in the operating member 172. A similar passageway 296 is formed in the nipple 174. Yet another similar passageway 298 is formed in the movable contact 52. All three of these passageways 294,296 & 298 are in communication and form a continuous path. One or more apertures 300 are formed through the wall of the operating member 172 and communicate with the passageway 294 therethrough. An aperture 302 is similarly formed through the nipple 174 to communicate with the passageway 296. When the movable contact 52 separates from the stationary contact 54 and an arc is formed therebetween, some contamination products are generated by the arc therearound, which contamination products may have the effect of inhibiting the action of the dielectric gas in extinguishing the arc. The continuous passageways 294,296 & 298 and the apertures 300 and 302, ensure that free gas flow not only at the exterior of the movable contact 52 but also at its interior is available to ensure that the concentration of these contamination products does not rise to a significant level. The central bore 68, the passageways 98 and the holes 100 and 102 serve a similar function with respect to the contacts 46 and 54.

Turning now to the upper portion of the interrupting unit 28, as depicted in FIG. 2, the bell housing 16 may be connected to, or may be integral with, an end plate 310. A saddle 312 is appropriately attached to the interior of the end plate 310. The saddle 312 mounts a threaded couplling 314 to which the stationary contact 44 may b3 threaded and held by a locknut 316. The stationary contact 44 may be threaded into or otherwise pass through an aperture 318 formed through a support and mounting ring 320. The stationary contact 44 may be locked to the support and mounting ring 320 by a locknut 322. One or more insulative support rods 328 may be appropriately connected between the support mounting ring 320 and the centering legs 194 of the bridge 190. These insulative support rods 328 serve the same function as the insulative support rods 282 discussed previously. Also connected between the support and mounting ring 320 and the centering legs 194 of the bridge 190, may be one or more voltage grading capacitors 332 to serve a similar function as the voltage grading capacitors 292, but across the gap opened between the contact pad 40. The stationary contact 44, as well as the threaded couplling 314, contains a continuous channel 336 which serves a function similar to passageway 294, 296 & 298.

The upper end of the interrupting unit 28 also includes elements 226, 230, 232, 240, 242 and 244 which are similar to the same elements found at the lower end of the interrupting unit 28. These elements are appropriately designated in FIG. 2.

Interrupting Unit 28—2-Gap—Operation

Assuming that the current in the circuit 24,26 is normal and that no event has occurred making it otherwise desirable to operate the interrupting unit 28, the interrupting unit 28 is in the condition depicted in FIGS. 2, 3, 6 & 7. Should an overcurrent in the circuit 24,26 occur, or, should some other event occur making it desirable to operate the interrupting unit 28, either the operating mechanism 30 or the shunt trip mechanism 31 initiates operation thereof by sudden rapid downward movement of the operating rod 170. Prior to this point in time, a continuous electrical path exists between the terminal pads 22 & 18, via the interrupting unit 28. The path for such current includes the terminal pad 22, the housing 20 for the operating mechanism 30, end plate 220, the tubular conductive member 254, the current transfer band 260, operating member 172, nipple 174, the movable contact 52, the stationary contact 54, inner wall 74 of the second cylinder 62, contact transfer band 154, the inner wall 64 of the first cylinder 60, the movable contact 46, the stationary contact 44, threaded coupling 314, the saddle 312, the end plate 310, and the terminal pad 18.

As the operating pad 170 moves downwardly, the movable contacts 46 and 52 begin to move away from their respective stationary contacts 44 and 54. Prior to the time the contact pairs 40 & 42 disengage, however, the piston-cylinder arrangements 72 & 82 begin to compress their respective compression chambers or volumes 70 & 80, causing the flow of the dielectric gas to the chambers 208 of the nozzles 206. Further downward movement of the operating rod 170 ultimately effects separation between the contact pairs 40 & 42. At this point, an arc is formed between each separated contact pair 40 & 42. Shortly thereafter, as the piston-cylinder arrangements 72 & 82 continue to flow gas, stationary contact 44 and the movable contact 52 clear shoulders 212 of the nozzles 206. The dielectric gas now flows from the chambers 210 of the nozzles 206 at sonic or near sonic velocity as the piston cylinder arrangements 72 & 82 continue the flow of gas, and the contact pairs 40 & 42 continue to separate. At some subsequent current zero, the combined effects of arc elongation due to the separating contact pairs 40 & 42, and the turbulent, cooling, deionizing effects of the dielectric gas extinguish the arc to interrupt the circuit 24,26. The opening stroke of the operating rod 170 is completed as the piston member 274 passes the apertures 278 in the tubular conductive member 254, slowing down and finally stopping, due in part to the dashpot action thereof.

Reclosing of the contact pairs 40 & 42, which may be either automatic or manual, depending on the nature of the operating mechanism 30, brings the contact pairs 40 & 42 back into engagement incident upon upward movement of the operating rod 170. As the compression chambers or volumes 70 and 80 re-expand due to the upward movement of the first cylinder 60 relative to the second cylinder 62 and the consequent action of the piston-cylinder arrangements 72 and 82, gas flows back thereinto through the gaps between the contact fingers 50 and 58, the chambers 96 and the passages 94. Once the stationary contact 44 has entered its nozzle 206 and the movable contact 52 has entered its nozzle 206, it is somewhat difficult for gas to re-enter the chambers 96 because of the slight sealing engagement between these contacts 44 and 52 and the shoulders 212 of the nozzles 206. Gas may, however, freely enter such chambers 96 through the channel 336 formed within the stationary contact 44 and also along the passageway 294,296 and 298. Gas passing by these routes passes between the various contact fingers 50 and 58 and into the chambers 96 and 208, from there passing into the expanding compressing chambers of volumes 70 and 80.

It should be noted that in the above-described embodiment of the present invention, no special facilities are present in the interrupting unit 28 for fault closing. However, the material of the various contact pairs 40 and 42 may be chosen to be fully capable of withstanding fault closing, should such be necessary, if the operating mechanism 30 is properly selected to be of a type which can extremely rapidly reclose such contact pairs 40 and 42.

Figure 4:
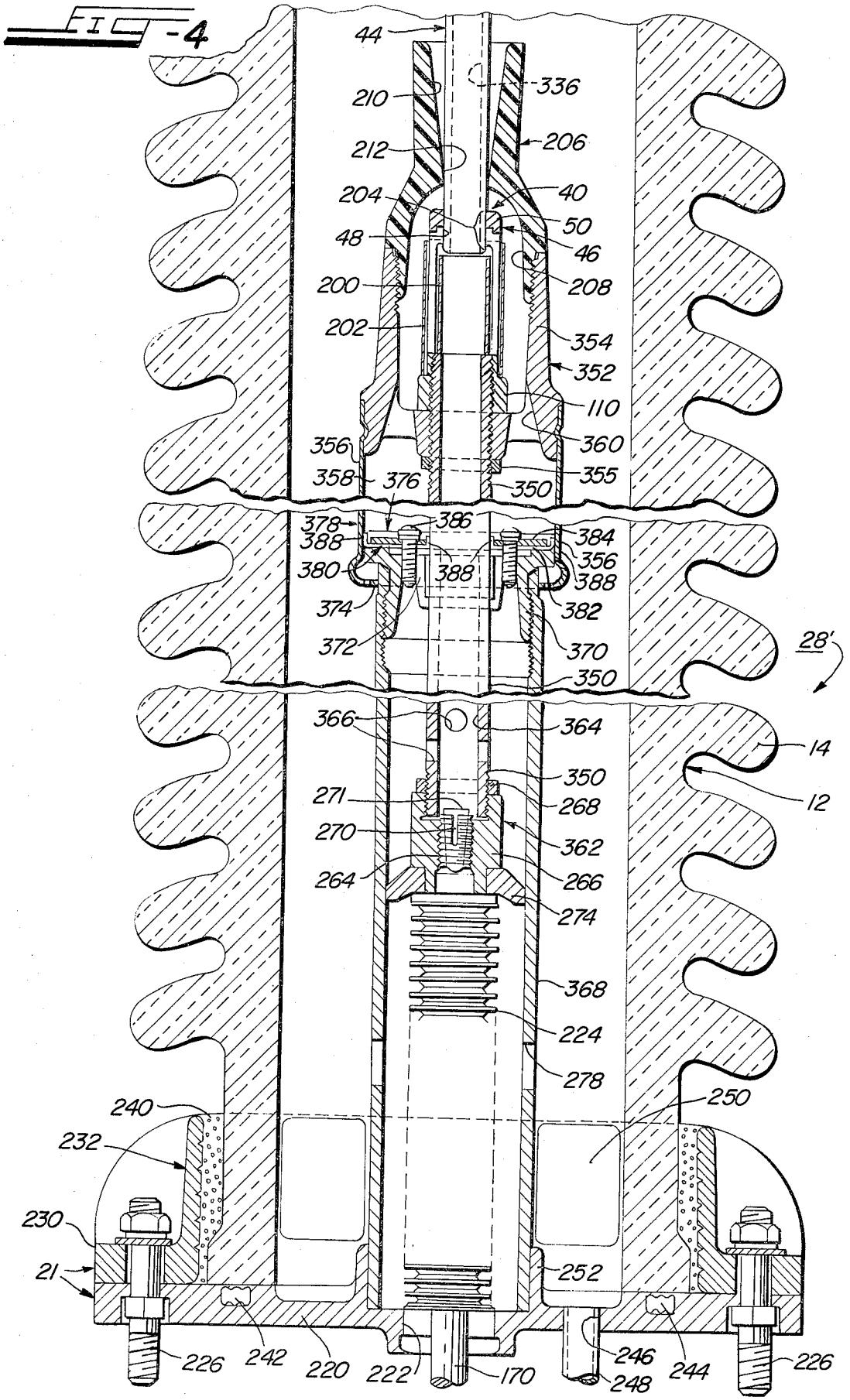
FIG. 4 is a side elevation, partially sectioned view of a single-gap interrupting unit according to the principles in the present invention usable in the device of FIG. 1, in place of the two-gap interrupting unit depicted in FIGS. 2 and 3.
Figure 5:
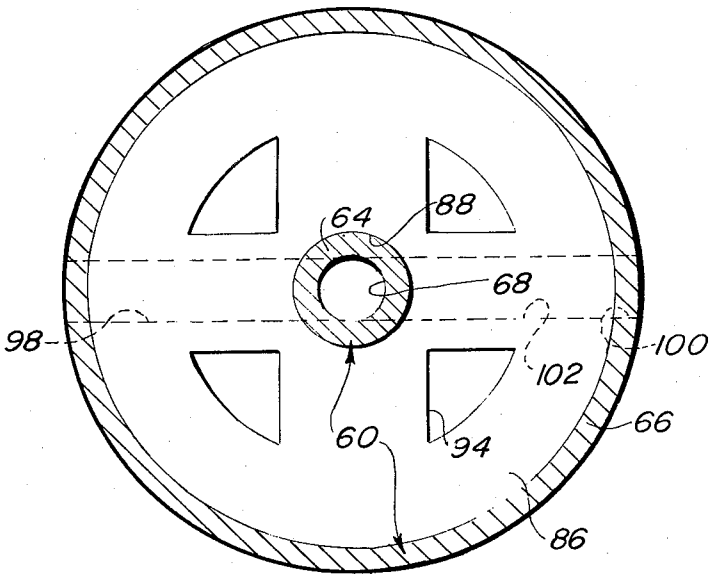
FIGS. 5 through 7 are greatly enlarged views of various elements of the interrupting unit depicted in FIGS. 2 and 3, showing these elements in greater detail.

Interrrupting Unit 28'—Single-Gap—FIG. 4

Described above has been an interrupting unit 28 which operates to produce two gaps between the contact pairs 40 and 42 during an interrupting of the circuit 24,26. Such a two-gap interrupting unit 28 may not be necessary or required by the conditions of the circuit 24,26. Accordingly, an alternative embodiment of a more generic version of the invention is depicted in FIG. 4. Specifically, FIG. 4 depicts an alternative interrupting unit 28' which is not only a single-gap interrupting unit, but which has also been simplified to a great extent with respect to the detail depicted in FIGS. 2 and 3. For example, FIG. 4 depicts no voltage grading capacitors such as 292 and 332, and no insulative support rods, such as 282 and 328. Portions not depicted in FIG. 4, but depicted in FIGS. 2 and 3, may be included as necessary or desired in the structure FIG. 4.

Moreover, to the extent possible, the same reference numerals as used in other figures to describe the two-gap interrupting unit 28 have been included in the interrupting unit 28' of FIG. 4.

The interrupting unit 28' of FIG. 4 includes a contact pair 40 which may be similar to that depicted in FIGS. 2, 3 and 7. The contact pair 40 includes stationary contact 44, stationarily mounted to the upper end (not shown) of the interrupting unit 28' by facilities (not shown) which may be similar to those depicted in FIGS. 2 and 3. The contact pair 40 also includes a movable contact 46 having contact fingers 50. The contact pair 40, when engaged, is surrounded by a nozzle 206, structurally and functionally similar to that previously described. Contact fingers 50 are mounted to or integrally formed with the collar 110. The collar 110 is threaded onto the upper end of a movable tubular electrically conductive cylinder 350. Also threaded onto the cylinder 350 is a nozzle carrier 352, slightly structurally different from, but otherwise similar to, the nozzle carriers 84 and 115 previously described.

The nozzle carrier 352 includes an upward extension 354 which carries the nozzle 206. Nozzle carrier 352 may be reliably held on the cylinder 350 by a jam nut 355, as shown.

Attached, as by magneforming or the like, to the lower end of the nozzle carrier 352 is a metallic cylinder 356 defining between itself and the outside of the cylinder 350, a compression volume 358, similar in function to the compression volumes 70 and 80. The compression volume 358 communicates with the chamber 208 of the nozzle 206 via passages 360 formed in the nozzle carrier 352. The cylinder 350 is connected as generally designated at 362 to the operating rod 170 for movement therewith. A passageway 364 formed through the cylinder 350 and one or more apertures 366 formed through the wall thereof, serve a function similar to that served by the channel 336 and by the passageways 294, 296 and 298 previously described.

Attached to the circular flange 252 of the end plate 220 is a tubular conductive member 368. The tubular conductive member 368 surrounds bellows 224, piston member 274 (similar to that previously described, and at or near the connection point 362) and the cylinder 350. The tubular conductive member 368 contains the apertures 278 which cooperate with the piston member 274 as previously described. The upper end of the tubular conductive member 368 is threaded onto a collar 370 which includes a current transfer band 372 similar in function to the current transfer band 260 previously described. The current transfer band 372 ensures constant electrical continuity between the tubular conductive member 368 and the cylinder 350 against which it is slidingly electrically engaged.

An opening 374 in the lower end of the cylinder 356 permits that cylinder 356 to move relative to the tubular conductive member 368 without interference therebetween.

Cooperating with the compression volume 358 are piston facilities 376. These facilities 376 are similar to the piston facilities 116 and 118 previously discussed. Together, the piston facilities 376 and the compression volume 358 constitute a piston-cylinder arrangement 378 which forces the dielectric gas within the compression volume 358 out of the nozzle 206 as previously described.

The piston facilities 376 include an annular piston member 380 made of a material similar to piston members 124 and 144. Piston member 380 includes a main body portion 382 which is trapped between the collar 370 and an annular mounting member 384 by appropriate fasteners such as screws 386. Integral with the main body 382 of the piston member 380 are arcuate flanges 388 which are structurally and functionally similar to the flanges 128, 130, 148 and 150 previously described. These flanges sealingly and slidingly engage the inside of the cylinder 356 and the outside of the cylinder 350.

The normal condition of the interrupting unit 28' of this embodiment of the present invention is shown in FIG. 4. Should it become desirable or necessary to interrupt the circuit 24,26, the operating rod 170 is moved downwardly as previously described. The downward movement of the piston rod 170 moves downwardly the cylinder 350 due to the connection 362 therebetween. This in turn moves the movable contact 46 downwardly, due to the connection between the cylinder 350, nozzle carrier 352, collar 110 and the contact fingers 50. Moreover, the nozzle 206 and the cylinder 356 connected thereto also move downwardly. During this time, the piston facilities 376 remain stationary as they are attached to the stationary tubular conductive member 368. The downward movement of the above-described elements separates the contacts 44 and 46 of the contact pair 40. At the same time, compression volume 358 moves relatively with respect to the piston facilities 376, decreasing such compression volume 358. This decrease in the compression volume 358 causes gas to flow first through the passages 360 and ultimately through the output chamber 210 of the nozzle 206. Circuit interruption proceeds as described previously with respect to FIGS. 2 and 3.

While specific embodiments in accordance with the principles of the present invention have been described herein, it should be apparent to those having skill in the art that various changes and modifications can be made thereto without departing from the scope thereof. For example, various materials may be the same or different as that disclosed herein as long as such materials functionally perform and achieve the same ends as the disclosed materials. Moreoever, various shapes and sizes, as well as physical relationships, can clearly be changed without departing from the scope of the present invention.

What is claimed is:

1. An improved high-voltage circuit interrupter of the type having a housing containing pressurized, arc-extinguishing dielectric gas; opposed terminals on the housing for respective connection to opposite sides of a circuit; and two pairs of normally engaged, mutually relatively movable contacts which upon disengagement create a pair of gaps in series, arcs in the gaps being interrupted; wherein the improvement comprises:

a first stationary contact continuously electrically connected to one of the terminals;

a first movable contact continuously electrically connected to the other terminal;

first conductive tube means mounted for axial movement and having first and second opposed ends;

a second movable contact carried by the first end of the first tube means, the second movable contact being selectively engageable with and disengageable from the first stationary contact upon axial movement of the first tube means;

second stationary conductive tube means having first and second opposed ends, the first movable contact being movable toward and away from the first end of the second tube means along the axis thereof, the first and second tube means being telescoped for relative axial movement at their second ends;

a second stationary contact carried by the first end of the second tube means for engagement with and disengagement from the first movable contact upon movement thereof; and means for electrically interconnecting the first and second tube means in all relative positions thereof.

2. An interrupter according to claim 1, which further comprises:

nozzle means carried by the first ends of the first and second tube means for directing gas flowing therethrough at the arcs formed in the respective gaps between the respective contact pairs following disengagement thereof; and piston-cylinder means carried by the first and second tube means at their second ends for forcing gas in the volumes enclosed by the telescoped tube means through the nozzle means as the tube means relatively move to disengage the contact pairs.

3. An interrupter according to claim 2, wherein:

each tube means is a double-walled cylinder, the walls of one cylinder being on the same side of the respectively adjacent walls of the other cylinder; and the piston-cylinder means comprise a first stationary piston carried by the inner wall of the other cylinder and sealingly engaging the walls of the one cylinder, and a second movable piston carried by the outer wall of the one cylinder and sealingly engaging the walls of the other cylinder, relative movement of the tube means as the contact pairs disengage decreasing the volumes defined by the pistons and the cylinder walls to force the gas through the nozzle means.

4. A dielectric gas circuit interrupting device, comprising a first stationary contact;

a first movable, double-walled conductive tube;

a first movable contact carried by the movable tube for movement into and out of engagement with the first stationary contact;

a second stationary contact;

a second, stationary, double-walled conductive tube carrying the secind stationary contact, the first and second tubes being electrically continuous and carrying substantially all of the current in the device;

a second movable contact movable into and out of engagement with the second stationary contact, the second movable contact and the movable tube being justly movable to simultaneously move the movable contacts out of engagement with their respective stationary contacts to open respective gaps therebetween;

a first piston carried by the stationary tube, the first piston and the walls of the movable tube defining a first piston-cylinder;

a second piston carried by the movable tube, the second piston and the walls of the stationary tube defining a second piston-cylinder, simultaneous movement of the second movable contact and the movable tube to open the respective gap causing the first piston-cylinder to flow the gas into the gap between the first contacts and the second piston-cylinder to flow the gas into the gap between the second contacts.

5. A device according to claim 4, wherein the tubes are telescoped.

* * * * *